US005802652A

United States Patent [19]

Smith

[11] Patent Number: 5,802,652

[45] **Date of Patent: *Sep. 8, 1998**

[54] BRIDGE DECK PANEL INSTALLATION SYSTEM AND METHOD

[75] Inventor: Peter Smith, Gansevoort, N.Y.

[73] Assignee: Fomico International, Schuylerville, N.Y.

[ * ] Notice: The term of this patent shall not extend beyond the expiration date of Pat. No. 5,617,599.

[21] Appl. No.: 669,170

[22] Filed: Jun. 24, 1996

Related U.S. Application Data

[63] Continuation-in-part of Ser. No. 444,390, May 19, 1995, Pat. No. 5,617,599.

[51] Int. Cl.[6] ..... E01D 19/12; E01D 21/00

[52] U.S. Cl. ..... 14/73; 14/77.1; 248/188.2

[58] Field of Search ..... 14/6, 73, 73.1, 14/73.5, 74.5, 77.1, 78; 52/223.6, 223.7; 254/5 R, 5 C, 88, 104; D8/47; 248/188.2

[56] References Cited

U.S. PATENT DOCUMENTS

| | | | |
|---|---|---|---|
| 3,253,289 | 5/1966 | Nagin | 14/73 |
| 4,709,435 | 12/1987 | Stemler et al. | 14/73 |
| 4,710,994 | 12/1987 | Kishda et al. | 14/6 X |
| 4,809,421 | 3/1989 | Justice | 248/188.2 X |
| 4,831,675 | 5/1989 | Nedelcu | 14/6 X |
| 5,025,522 | 6/1991 | Eskew et al. | 14/6 X |
| 5,617,599 | 4/1997 | Smith | 14/73 |

FOREIGN PATENT DOCUMENTS

| | | | |
|---|---|---|---|
| 350137 | 1/1990 | European Pat. Off. | 14/73 |
| 2510156 | 1/1983 | France | 14/73 |
| 2698111 | 5/1994 | France | 14/73 |
| 4-182501 | 6/1992 | Japan | 14/73 |
| 2227266 | 7/1990 | United Kingdom | 14/73 |
| WO 88/09413 | 12/1988 | WIPO | 14/73 |
| WO 89/11003 | 11/1989 | WIPO | 14/73 |

*Primary Examiner*—James Lisehora
*Attorney, Agent, or Firm*—Schmeiser, Olsen & Watts

[57] ABSTRACT

A system and method for the installation of prefabricated composite structural members is disclosed. The system utilizes deck panels which have a plurality of structural member pairs attached to the underside such that a series of channels are formed. Bored through each deck panel is a plurality of access holes that project through the panel and into one of said channels. Thus, installers can access underlying bridge girders from the surface of the deck panels thereby allowing for top-side installation. The system also provides a top-side vertically adjusting device for raising or lowering the deck panels to allow for the top-side installation of shimming devices.

23 Claims, 8 Drawing Sheets

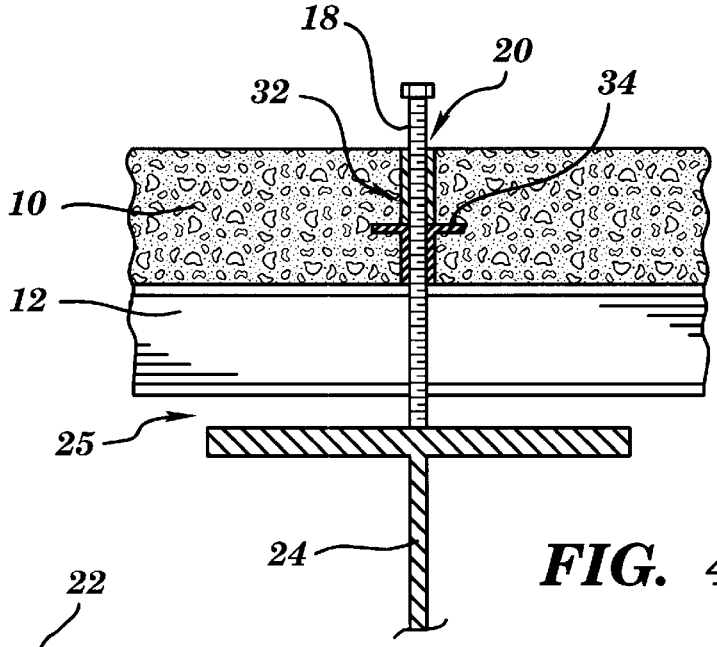
FIG. 4
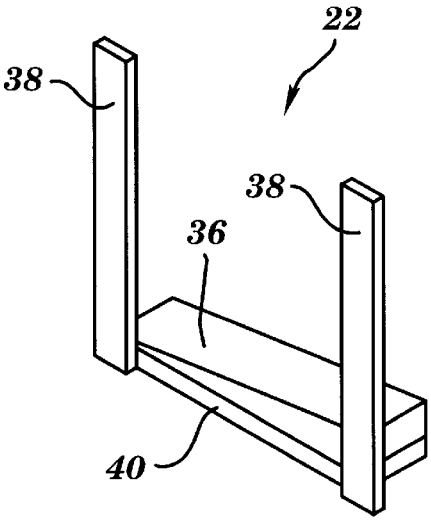
FIG. 5
FIG. 6
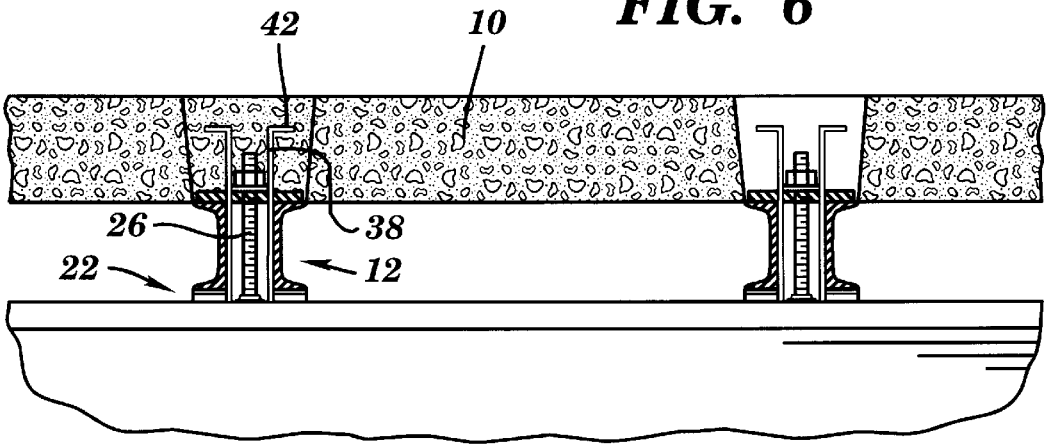

BRIDGE DECK PANEL INSTALLATION SYSTEM AND METHOD

This application is a Continuation-In-Part of parent application Ser. No. 08/444,390 filed May 19, 1995, entitled "BRIDGE DECK PANEL INSTALLATION SYSTEM AND METHOD", now U.S. Pat. No. 5,617,599.

BACKGROUND OF THE INVENTION

1. Technical Field

The present invention generally relates to a system and method for installing composite structural members. More particularly, the present invention relates to the installation of precast concrete bridge deck panels onto a bridge girder (stringer) system by incorporating a system of holes, beams, an adjusting apparatus (e.g. a shim), and an attachment device (e.g. nuts, washers, etc.).

2. Background Art

Precast concrete deck panels are currently considered the state of the art for forming bridge decks between girders and bridge construction. The use of such deck panels has proven to be both economical and convenient. The present installation techniques of such systems present the disadvantage that workers need to work beneath the deck panels in order to install the systems. Thus, additional costs and inconveniences are added to the installation procedure. These inconveniences may include scaffolding which may need to be assembled under the bridge.

Another disadvantage of presently designed precast concrete deck panels is that they are vertically supported in their correct position on the girder or stringer by a grout material (cementations or otherwise). Not only is the grout costly to buy but costly forms must typically be provided to install it.

Another disadvantage of grout-supported systems is that the grout must harden to a specified strength before traffic loads may be placed upon the panel. This is particularly troublesome when it is necessary to place this type of deck overnight, where traffic volumes are so large that the deck simply cannot be out of service during the day.

The typical installation of present-day precast panels may include hold down bolts that tie down the deck panel to bridge girders. Since these systems typically fasten through the top flange of the girders (or stringers), difficult labor intensive tasks below the bridge deck surface are created. A similar problem arises when attempting to install grout between the precast deck panel and the supporting girders (or stringers). In these situations the deck panels need to be supported in their correct vertical position while supporting grout is placed. Again, a difficult and labor intensive task involving workers below the deck surface is required.

Thus, a need exists for an installation system for precast concrete deck panels which would allow for complete installation from the top side of the deck panels including the installation of adjustment devices (e.q. shims) and for a system which is ready for immediate usage upon installation, without waiting for the grout to harden. Providing such an installation system would eliminate the time consuming assembly and removal of grout forms and an underneath scaffolding system.

SUMMARY OF THE INVENTION

The present invention satisfies the need for a system and method of top side installation of bridge deck panels onto bridge girders. The present invention provides, in a first aspect, precast deck panels with opposed pairs of steel support members such as I-beams, C-beams, tubular supports, or the like attached on the bottom thereto. In between each C-beam, I-beam or support member pair is an open channel. In addition , each deck panel contains access holes which run through the deck panels such that each hole begins on the surface of the deck panel and terminates on the bottom of the deck panel in between support member pairs in the aforementioned channel. Each access hole has a width that is greater than the minimum width of the channel, so that at least a portion of the support member pair is exposed from the surface of the deck panel via the access hole creating a pair of opposed ridges.

The present invention provides, in a second aspect, deck panels containing a plurality of threaded inserts which allow for a temporary adjusting bolt to be screwed through and onto an underlying bridge girder, thereby allowing the deck to be raised so that shims can be placed thereunder.

Another aspect of the invention is providing a plurality of shims that may be installed from the top of the deck. The shims may be of varying height to compensate for various tolerances between the girder and deck panels. The shims also advantageously act as structural support members which allow immediate usage of the deck panel.

Yet another advantage of the present invention is to provide a precast concrete deck that may be quickly and efficiently installed allowing travel there over before the final concrete is poured to anchor the panel. Since the deck of the present invention is installed as panels, long-term maintenance is relatively easy. The panels need simply to be replaced with a new panel using similar installation techniques.

Another advantage is that true composite action between deck and supporting stringer is easily and economically obtained.

In another aspect of the present invention, a rod is positioned between support members and in an access hole of a deck panel. Grout is poured to embed the rod thereby holding the deck panel in place.

BRIEF DESCRIPTION OF THE DRAWINGS

These and other advantage of the present invention will become more readily apparent upon reading the following detailed description and upon reference to the drawings to which:

FIG. 4 depicts a cross sectional view of an adjusting bolt pursuant to the present invention;

FIG. 5 depicts a shimming device as described in the present invention;

FIG. 6 depicts a cross sectional view showing the final installation of the system pursuant to this invention;

DETAILED DESCRIPTION OF THE PREFERRED EMBODIMENTS

Figure 1:
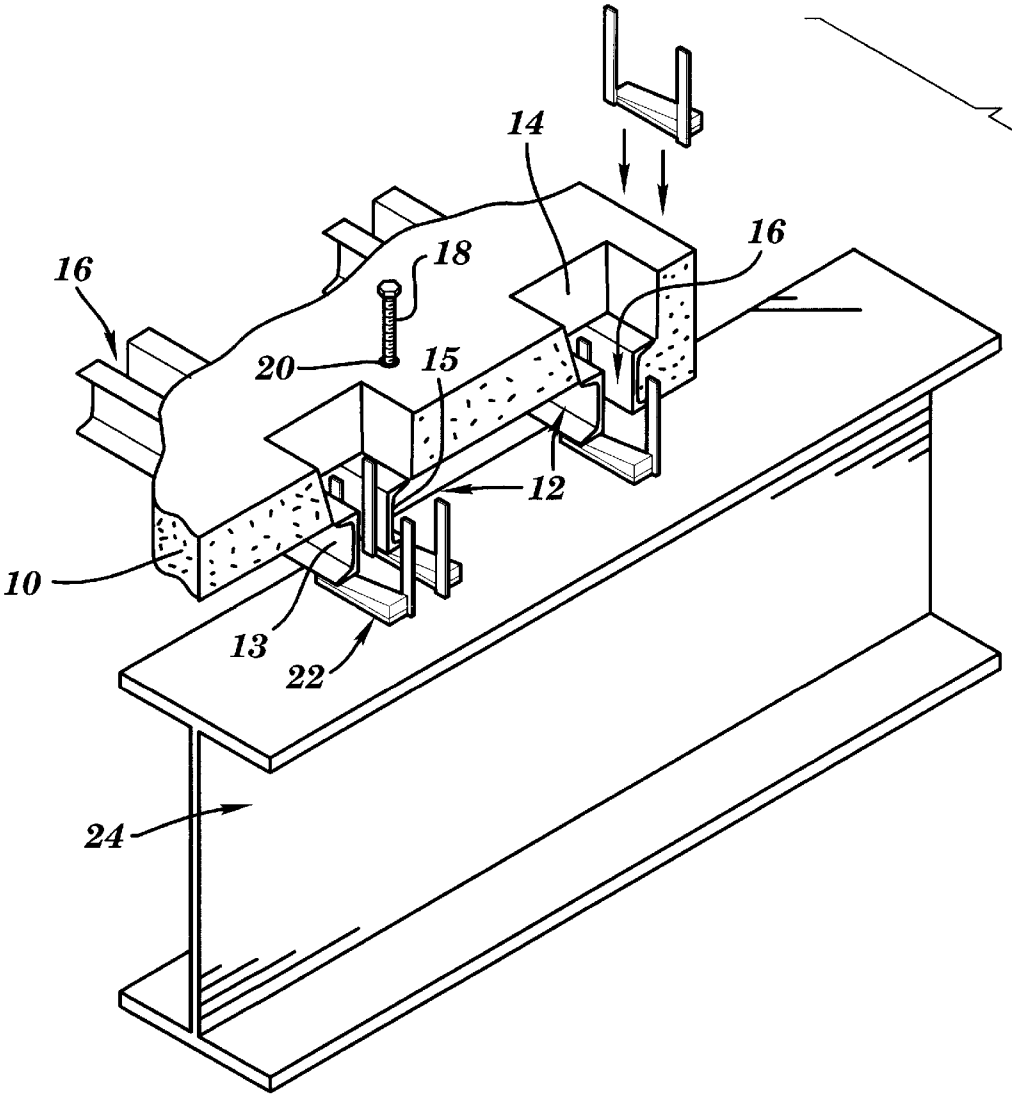
FIG. 1 depicts an isometric section showing the essential aspects of the preferred embodiment pursuant to the present invention.

Referring now to the drawings, and more particularly to FIG. 1, there is shown some of the parts which make up the decking installation system pursuant to this invention.

The decking system of the present invention includes concrete deck panels 10, each having a plurality of steel C-beam pairs 12 mounted thereto by means of commonly used stud or other well known shear connectors (not shown) (this combination hereinafter referred to as the "channel deck"). It is envisioned that the deck panels and underlying steel C-beams (i.e. the channel decks) may be pre-formed as a single pre-stressed structural member in a manner known or used in the art.

Each C-beam pair 12 is comprised of a left C-beam 13 and right C-beam 15. The C-beams 13 and 15 are spaced apart such that a channel 16 is formed between the left and right C-beams beneath the decking panel 10. During installation, C-beam pairs 12 rest upon, and are mounted to, a system of existing bridge girders 24 or stringers. During the installation of a bridge decking system, shims typically need to be installed between the existing bridge girder and the underlying steel support beams to overcome imperfections in the girders or to create any necessary inclines or cross slopes in the roadway. Pursuant to this invention, shims 22 are utilized in a manner described below.

Deck panels 10 also comprise a plurality of access holes 14. Access holes provide the installers of the channel deck a means of accessing the underlying bridge girder from the surface of the deck panel. This means may include a nut and hold-down plate which would fasten down onto one or more bolts welded to the underlying girder (See FIG. 2). Other means of attachment involving clamping or fastening devices known in the art, while not specifically disclosed, may also be utilized.

The access holes 14 also permit shims 22 to be placed into position below the deck panel by workers on the surface of the deck panel. This is made possible through the use of adjusting bolt 18. Adjusting bolt 18 is a temporary device which can be inserted into and through hole 20. As the bolt is screwed through the decking surface, it will eventually come out of the bottom and press against existing girder 24. As the bolt is screwed through the decking surface, it will eventually come out of the bottom and press against existing girder 24. As the bolt is further engaged it will raise up decking panel 10 thereby allowing shims 22 to be easily placed in between C-beam pairs 12 and bridge girder 24 via access hole 14.

Figure 2:
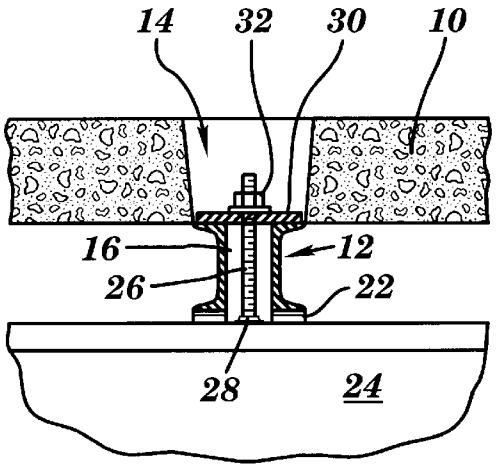
FIG. 2 shows a cross sectional view of the installation system pursuant to the present invention.

Referring now to FIG. 2, a cross sectional view is shown depicting a preferred means of mounting the channel deck to the underlying girder pursuant to this invention. Steel C-beam pair 12, which was pre-formed with concrete deck panel 10, is shown laying on girder 24. Pursuant to this embodiment, a plurality of bolts 26 are welded 28 to girder 24 at predetermined positions after laying of the channel deck. The bolts 26 are welded such that they extend up through channel 16 (formed by C-beam pair 12) and into access hole 14. A welding gun having an elongated end is used to securely fasten the bolts into place.

To positively secure the decking to the underlying girders, hold-down plate 30 is used. It should be appreciated from this that this system allows for the complete securement of the structural member onto the girder system from the top surface of the deck panels. This is accomplished without the use of supporting grout, which is expensive, costly to install, and must sufficiently harden before the deck can be used.

Figure 3:
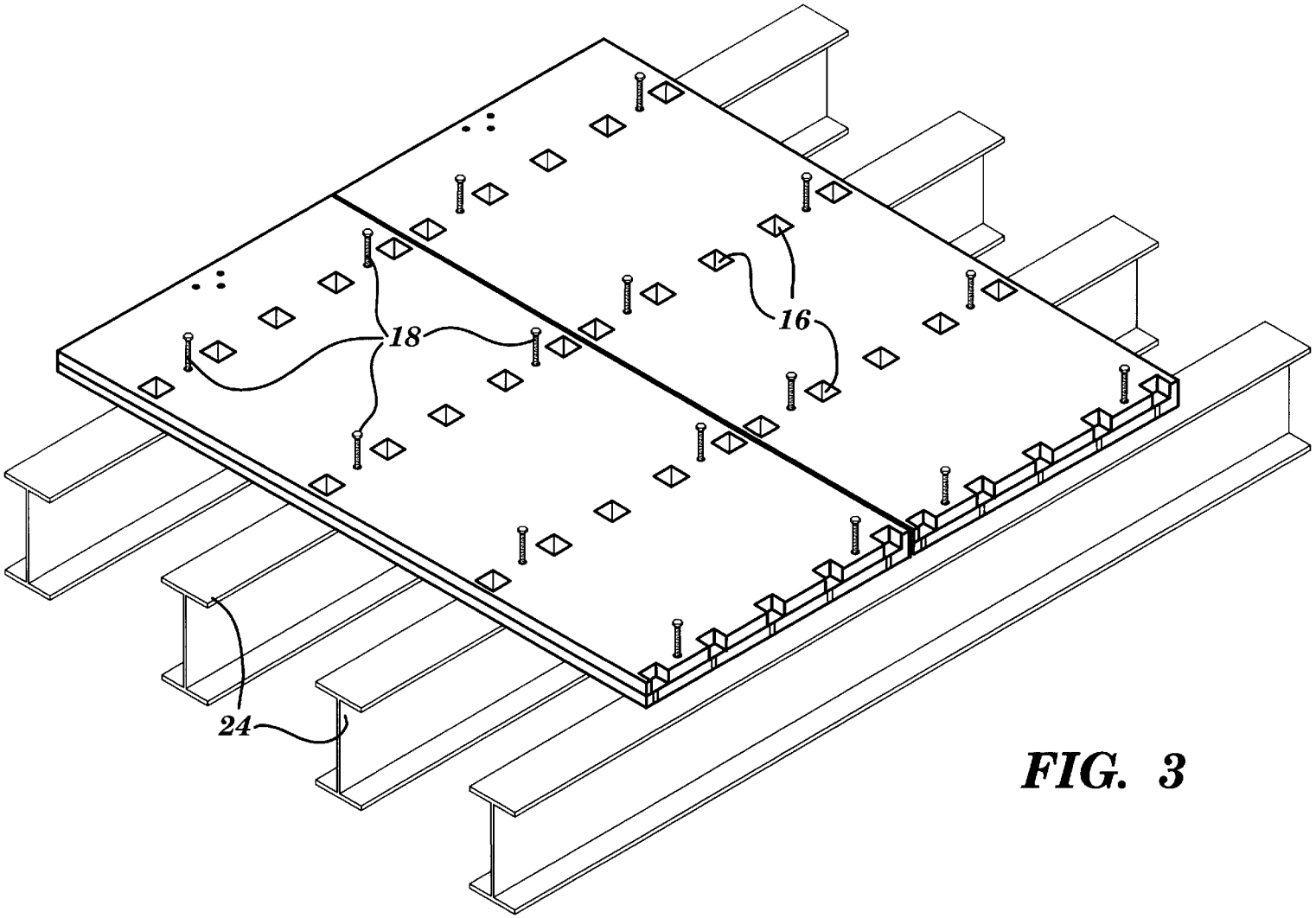
FIG. 3 depicts an isometric view of the deck panels pursuant to the present invention.

Referring now to FIG. 3, the top surface of a pair of typical deck panels are shown resting on top of a system of girders 24. As is evident from the drawing, access holes 16 and adjusting bolts 18 are specifically located to line up with the underlying girders 24. As noted above, adjusting bolts 18 can be utilized to lift the decking, thereby allowing shims to be placed between the C-beam pairs (not shown) and the underlying girder 24 via access holes 16. Again, this process can be done entirely from the surface of the deck panel.

Referring now to FIG. 4, a cross-sectional view of an adjusting bolt is shown. Adjusting bolt 18 is inserted into a hole 20 in deck panel 10 which may be partially lined with a PVC sleeve 32. The bolt 18 is threaded through insert 32 and projects out of the bottom of the deck panel. The height between each C-beam and girder 24 is measured and an appropriate shim 22 is selected to match the height. The shims 22 are pre-manufactured to be of varying height such that an appropriate height shim may be selected to match the height between each C-beam and girder. After a height has been determined and a shim selected, the bolt is further turned to engage girder 24 and lift the deck panel further off of the girder 24. Screwing of bolt onto girder 24 creates a greater gap between the C-beam pari 12 and the girder 24. By utilizing a nearby access hole shims can be strategically placed from above the deck panel. After the shims have been inserted, the adjusting bolt 18 can be removed, thereby lowering the channel deck back onto the underlying girder 24.

Referring now to FIG. 5, one of the many possible embodiments of a shim 22 which could be used pursuant to this invention is shown. The shim 22 may typically comprise a base 40, an inclined plane 36, and one or more vertical tabs 38. As is shown in FIG. 6, each shim 22 is designed to be placed down into an access hole, in between a C-beam pair 12, and underneath one of the C-beams. Vertical tabs 38 allow for easy maneuverability of the shim 22 for placement thereof. Vertical tab 38 may also comprise a bent portion 42 which will 1) further improve maneuverability of the shim during installation and 2) increase the anchorage of the shim after placement of grout. Note that hold-down plate 30 (see FIG. 2) may need to be specifically designed to not interfere with the placement of the vertical tabs 38.

Upon completion of the installation procedure outlined above, the only remaining step is to fill the access holes. Typically, as is shown in the left access hole of FIG. 6, a concrete mixture or other known paving material can be used to fill the hole. A bend 42 in the vertical tabs 38 of the shims 22 provides an anchor bolt action after the access hole has been filled. When it is necessary to more fully develop composite action between the deck panel 10 and the underlying girder 24, the channel 16 below the access hole 14 is also filled with the same concrete mixture.

Figure 7:
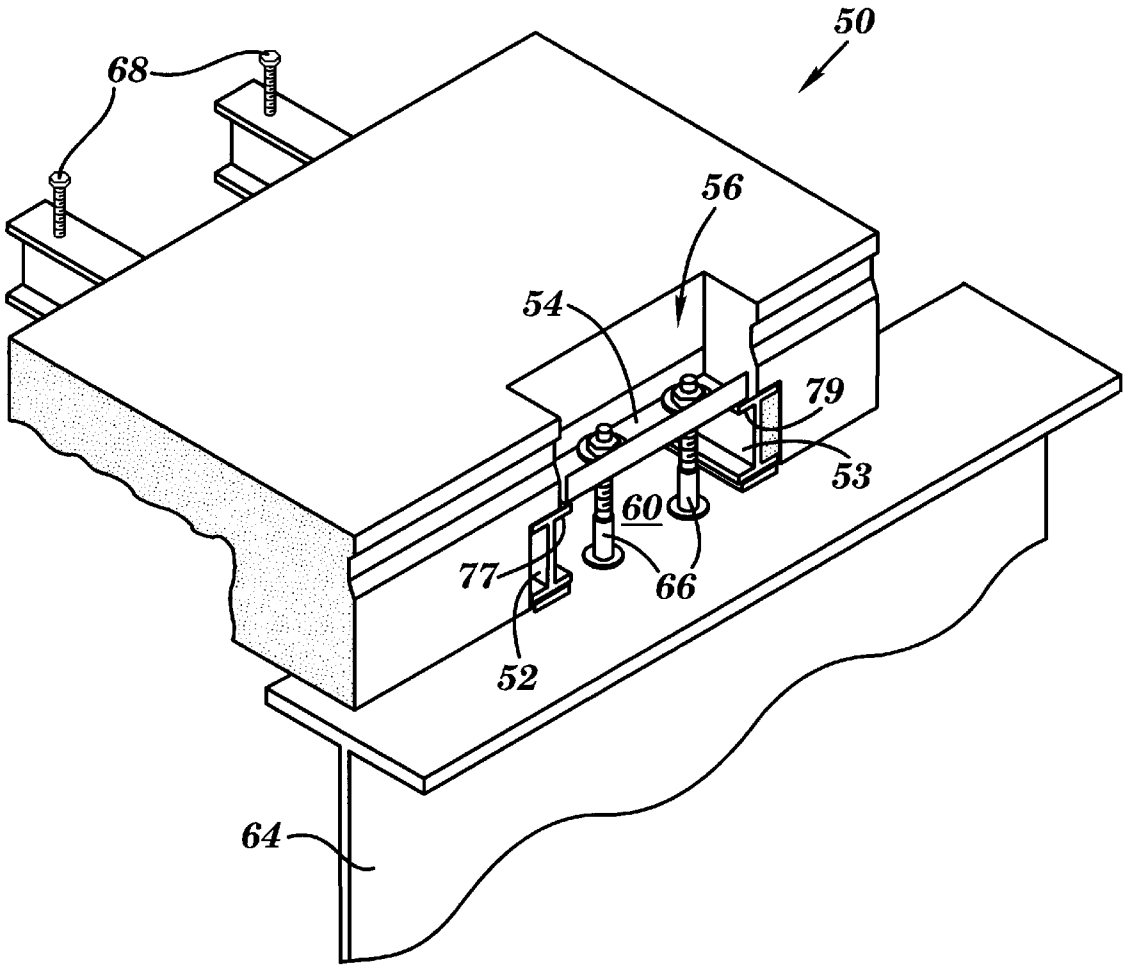
FIG. 7 depicts an isometric view of an alternative preferred embodiment of the present invention that includes an I-beam pair and a multiple-bolt attachment device.

Referring now to FIG. 7–10, an alternative embodiment of a deck panel system 50 is disclosed that utilizes an integrated I-beam support pair 52, 53 and a multiple-bolt attachment device 54. FIG. 7 shows an isometric view of the alternative embodiment of the deck panel cut through access hole 56. It can be seen that the channel 60 formed between the I-beam pair 52, 53 has a width that is less than the width of the access hole 56 (see FIG. 8 for additional detail). The result is that a top portion of each I-beam 52,53 forms a ridge 77, 79 within the access hole 56 that is exposed to the surface of the deck panel 50.

As shown in FIG. 7, the deck panel 50 is placed upon existing girder or stringer 64. Stringer 64 has a plurality of bolts 66 affixed thereto projecting upward. Bolts 66 are placed along stringer 64 such that they will project through channel 60 into access hole 56 after the deck panel 50 is placed on the stringer. It is preferable to have as many bolts as required by design through each access hole (see FIG. 8) in order to achieve the required composite action between the panels 10 and the stringers 64. Because the integrated I-beam support pairs 52, 53 form exposed ridges 77, 79, a simple attachment device 54 may be fastened onto the bolts 66 to hold the deck panel 50 in place. Attachment device 54 is described in more detail in FIGS. 8–9. Finally, like the embodiments discussed above with respect to FIGS. 1–6, shimming devices (see FIGS. 1 and 5) can be inserted from the top of the deck panel 50 during installation with the aid of adjusting bolts 68. The entire system and method of installing shimming devices and utilizing adjusting bolts are the same as that disclosed with respect to FIGS. 1–6.

Figure 8:
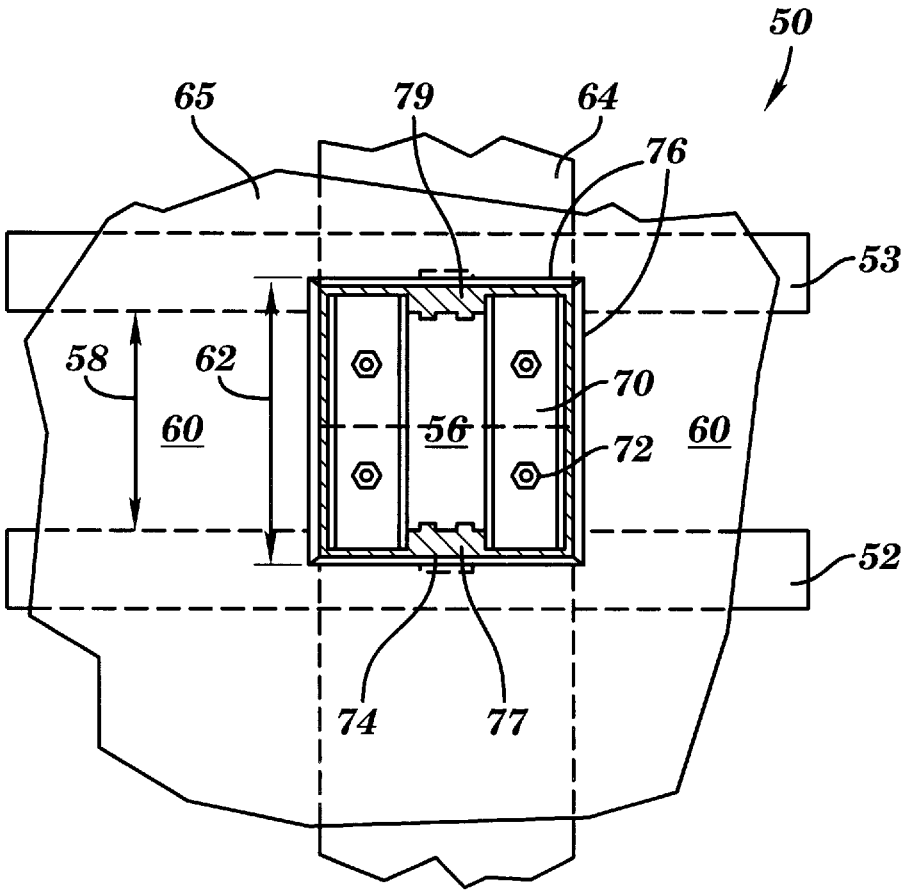
FIG. 8 depicts a top view of the embodiment of FIG. 7.
Figure 9:
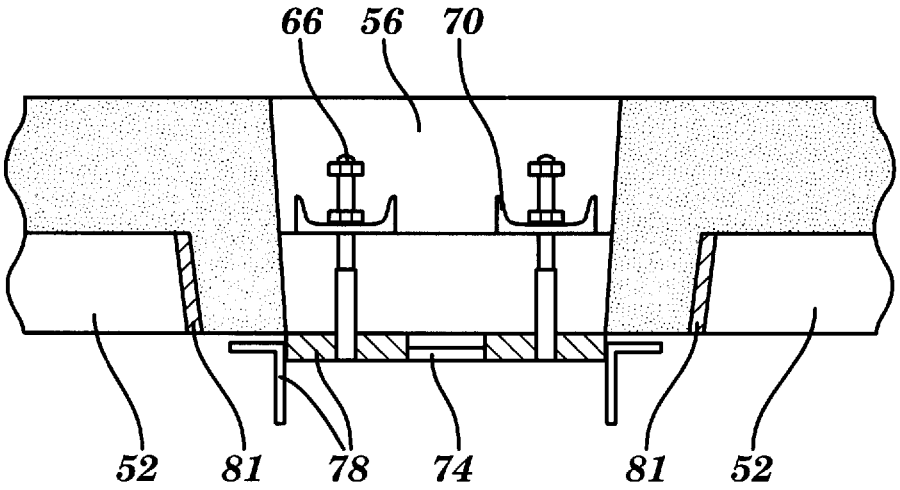
FIG. 9 depicts a cross-sectional view of the embodiment of FIG. 7 cut along section X—X of FIG. 8.

FIG. 8 depicts a top view of deck panel 50 looking down through access hole 56 shown with perimeter 76. Like the previous embodiments, deck panel 50 includes a concrete surface 65 with integrated support beams 52, 53 which will rest upon existing girder 64. Because the width 62 of the access hole is greater than the respective minimum width 58 of the channel 60 formed by the support members 52, a portion of the top of the support members will be exposed in the access hole 56 to form a pair of ridges 77 and 79 (hatched area). An attachment device comprised of one or more channel washers 70 and one or more nuts, washers, etc. 72 may then be utilized to attach the deck panel to the existing girder 64. Also shown in FIG. 8 is a shim 74 placed between a support member and existing girder 64. The particular embodiment shown here depicts an existing girder with four bolts projecting into access hole 56 and two channel washers 70, each having two holes for receiving the four bolts. As noted, more or less bolts or channel washer designs may be used as necessary. Alternatively, the channel washer may be omitted on one or all of the attachment locations. Anchorage of the panel will then be achieved by the shearing action of the bolts and the pairs of ridges 77 and 79. FIG. 9 depicts a cross section of the embodiment of FIG. 8 cut along section X—X. In addition to the elements and parts previously described, a perimeter seal 78 is shown which may be introduced during the installation process.

Figure 10:
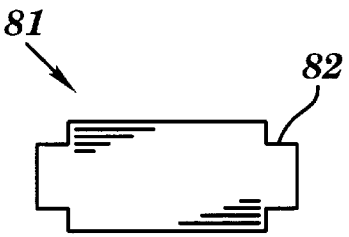
FIG. 10 depicts a form used with the embodiment of FIG. 7.

FIG. 10 depicts a form used with the embodiment of FIG. 7 and 9. Form 81 is shown in cross-section in FIG. 9. The form 81 is inserted between the I-beam members 52 and 53 and parallel to the edges of the stringer 64. After the forms 81 have been inserted, then grout is poured into the access hole so that the deck panel may be held in place by the grout. The notch portions 82 of the form 81 are inserted into the channel portion of the I-beam 53.

Figure 11:
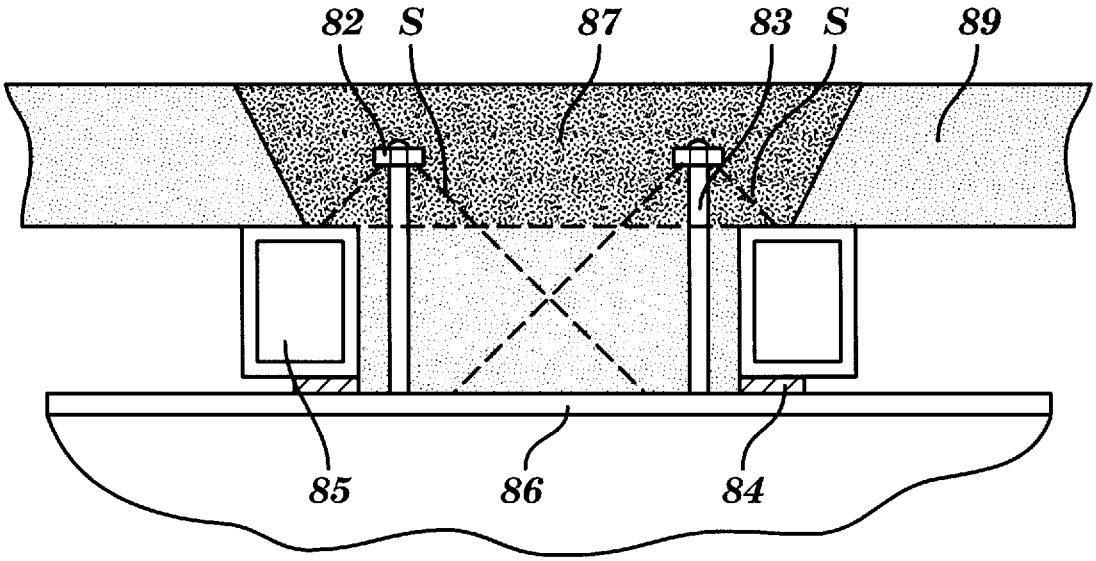
FIG. 11 depicts a cross-sectional view of an alternate embodiment of the present invention.
Figure 12:
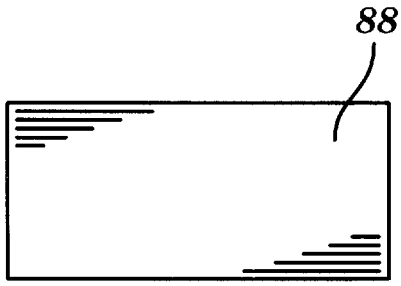
FIG. 12 depicts a form used with the embodiment of FIG. 11.
Figure 13:
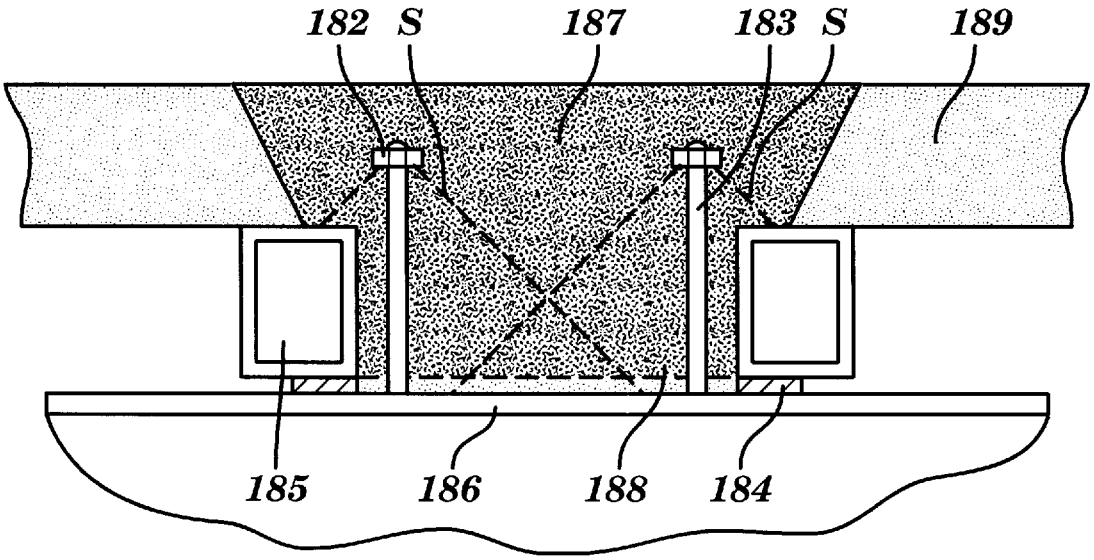
FIG. 13 depicts a cross-sectional view of an alternate embodiment of FIG. 11.

FIG. 11 depicts an alternate embodiment of the present invention. This embodiment does not include an attachment device such as 54 shown in FIG. 7. The deck panel 89 is held in place by bolts 82 and 83 which are surrounded by grout 87. A form 88 is placed parallel to the edges of the stringer 86 for providing a form for the grout when pouring. A preferred alternative is to eliminate grout form 88 altogether. This is easily done during the casting process as shown in FIG. 13 since the straight sides of the tube permit easy casting of a concrete wall 188 that takes the place of form 88. Upon setting of the grout, shear lines S are developed between the end of the bolts 82 and 83 and the stringer and channel member 85. The advantage of this embodiment is that notch portions are not required in the form 88, thus facilitating greater ease of installation of the form 88, as opposed to the form shown in FIG. 10. Tube members 85 provide adequate structural support for installation of the bridge deck 89. The embodiment of FIG. 11 is used when adequate time is permitted for the grout to set before traffic activity begins. If the bridge must be used immediately, channel washers 54 are used similar to that shown in FIG. 7 so that the bridge deck may be tied down directly without having to wait for the grout to set. In addition, the tube embodiment does not require as much grout to fill and also eliminates a cumbersome form.

Although the preferred embodiment of this invention is specifically directed to bridge the decking systems, it is envisioned that this system could be adapted in any situation where the installation of structural members is required.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A bridge decking system attachable to a system of existing stringers comprising:

at least one deck panel having a top surface and a bottom surface, said deck panel having a plurality of access holes projecting from said top surface down through to said bottom surface, wherein each access hole includes a pair of opposed ridges located proximate said bottom surface that are accessible from said top surface of said deck panel via each said access hole; and at least one channel washer, said channel washer being positionable upon said pair of opposed ridges.

2. The bridge decking system of claim 1 wherein said pair of opposed ridges are formed from a pair of structural members integrated to an underside of said deck panel.

3. The bridge decking system of claim 2 wherein said pair of structural members include a pair of I-beams.

4. The bridge decking system of claim 2 wherein said pair of structural members include a pair of tubular members.

5. The bridge decking system of claim 2 wherein said pair of structural members include a pair of C-beams.

6. The bridge decking system of claim 1 wherein at least one channel washer has a length greater than the distance between said opposed ridges and less than a respective width of said access hole.

7. The bridge decking system of claim 6 wherein said existing girder includes at least one bolt mounted vertically thereon at a position wherein said at least one bolt will project up through said access hole.

8. The bridge decking system of claim 1 further comprising a plurality of adjusting bolts for raising said deck panel, said adjusting bolts accessible from a top surface of said deck panel.

9. The bridge decking system of claim 1 further comprising at least one shim, said at least one shim having a vertical member for aiding insertion of said shim between said deck panel and said existing girder via said access hole.

10. A prefabricated deck panel comprising:

a top surface and a bottom surface;

a plurality of access holes in said deck panel projecting from said top surface through to said bottom surface; and at least one shim that is insertable down through a selected access hole, said at least one shim having a mechanism for facilitating lateral placement of said shim beneath said bottom surface of said deck panel with respect to said selected access hole.

11. The prefabricated deck panel of claim 10 further comprising adjusting bolts for raising said deck panel, said adjusting bolts being accessible from said top surface.

12. The prefabricated deck panel of claim 10 further comprising at least one channel washer for placement into one of said access holes.

13. The prefabricated deck panel of claim 12 wherein said channel washer has at least one pair of holes for receiving at least one vertical bolt mounted on an existing girder.

14. The prefabricated deck panel of claim 13 wherein said channel washer further comprises at least one nut for attachment to said vertical bolt.

15. A method for installing bridge deck panels on existing girders comprising the steps of:

providing composite deck panels that include access holes having opposed ridges formed therein;

mounting vertical bolts at predetermined locations on said existing girders;

placing said composite deck panels onto said existing girders so that said vertical bolts project up through said access holes;

adjusting the vertical position of said composite deck panels on said existing girder with shims placed through said access holes;

placing a channel washer into an access hole and onto said opposed ridges such that at least one of said vertical bolts projects through said channel washer; and placing at least one nut onto said bolt over said channel washer.

16. The method of claim 15 wherein each of said composite deck panels includes adjusting bolts for raising said deck panel from a top surface of said deck panel during said adjusting step.

17. A bridge decking system attachable to a system of existing stringers comprising:

a deck panel having a plurality of access holes therein;

a steel support member mounted across a lower surface of said deck panel; and a shim positionable between said steel support member and said stringers via one of said access holes.

18. The bridge decking system of claim 17, further comprising at least one rod projecting from grout, said stringer.

19. The bridge decking system of claim 18, further comprising grout, said grout embedding a bolt, whereby stress lines may be created for holding said deck panel, said support member and said shim in place.

20. The bridge decking system of claim 17, wherein said support member is tubular.

21. The bridge decking of claim 20, wherein a removable form is used for containing grout when poured.

22. The bridge decking of claim 20, wherein an integral concrete form is used for containing grout when poured.

23. The bridge decking system of claim 17, wherein said support member is an I-beam.

* * * * *